United States Patent [19]

Ihasz et al.

[11] 4,125,940

[45] Nov. 21, 1978

[54] HAIR TRIMMER

[75] Inventors: Richard Ihasz, Milford; Antonio Pires, Wallingford, both of Conn.

[73] Assignee: Sperry Rand Corporation, Bridgeport, Conn.

[21] Appl. No.: 825,331

[22] Filed: Aug. 17, 1977

[51] Int. Cl.[2] ..... B26B 19/06; B26B 19/20

[52] U.S. Cl. ..... 30/220; 30/200

[58] Field of Search ..... 30/90, 210, 216, 218, 30/220, 221, 200

[56] References Cited

U.S. PATENT DOCUMENTS

| | | | |
|---|---|---|---|
| 3,030,707 | 4/1962 | Garvey | 30/90 |
| 3,842,498 | 10/1974 | Mizobata | 30/216 |
| 3,962,785 | 6/1976 | Poel | 30/90 |
| 3,992,778 | 11/1976 | Urbush | 30/216 |

*Primary Examiner*—Jimmy C. Peters

*Attorney, Agent, or Firm*—Charles R. Miranda; Joseph S. Failla

[57] ABSTRACT

A hand-held electrically energized hair trimming appliance is disclosed which is adapted to alternatively utilize a demountable clipper assembly or a demountable trimmer assembly. The demountable trimmer assembly includes an extending segment for supporting a trimmer cutter assembly at a location displaced from a housing of the appliance for enhancing user visibility when trimming mustaches, hair around earlobes, and the like.

10 Claims, 10 Drawing Figures

Fig. 7.
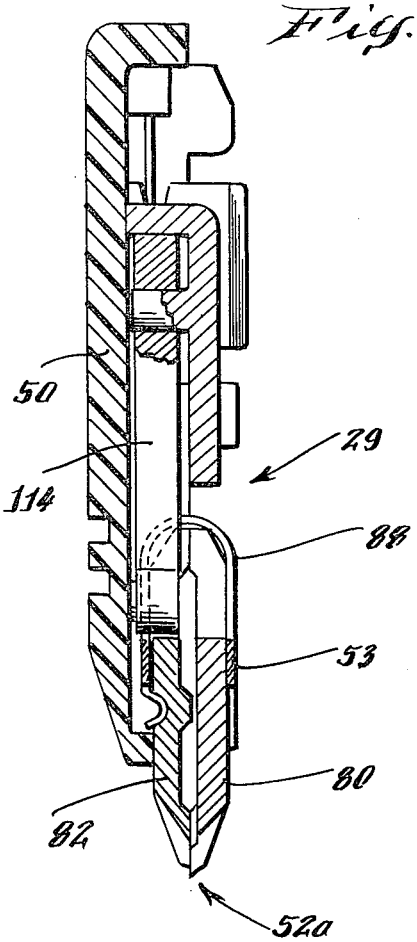
Fig. 8.
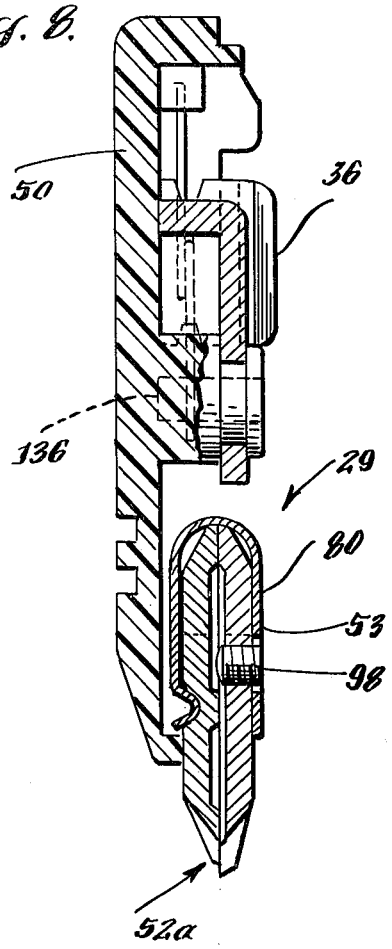
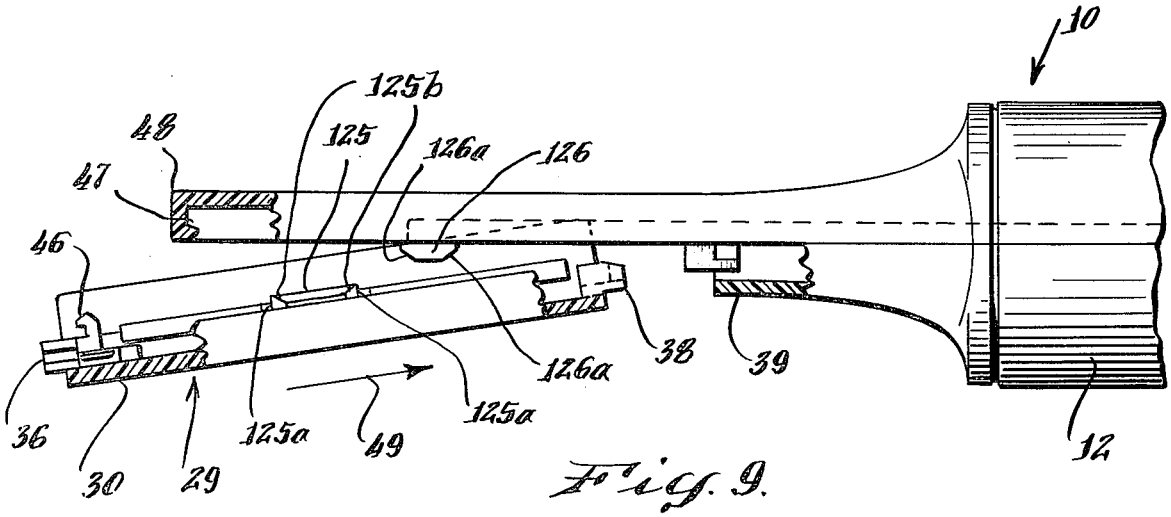
Fig. 9.

HAIR TRIMMER

BACKGROUND OF THE INVENTION

This invention relates to hair trimming appliances. The invention relates more particularly to interchangeable clipping cutters and trimming cutters which facilitate hair trimming.

An improved electrically energized hair trimming appliance which permits an individual to trim his own established hairdo or an untrained person to trim another party's hairdo without gouging, overcutting or causing damage to a hair style is described and is claimed in a co-pending U.S. patent application Ser. No. 825,335 which is assigned to the assignee of this invention. In that device, a comb-shaped force applying means and a clipper cutter are simultaneously advanced through the hair being trimmed in a particular spatial relationship. This relationship provides that a majority of hair segments, which are sheared, are of a predetermined, substantially same length.

A clipper cutter utilized with the above mentioned trimming device has an elongated array of relatively coarse teeth for shearing relatively larger gatherings of hair which are guided to the cutter by the comb. While the elongated array of relatively coarse teeth is desirable for trimming a hairdo, the coarseness and length of the tooth array is deemed to be unsatisfactory for relatively close hair trimming of such body areas as the lower rear neck, upper lip mustaches, earlobes and other personal hair growth which is to be trimmed close to a person's skin. The latter trimming requires a relatively high degree of control while the length of the clipper cutter tooth array for shearing relatively large gatherings of hair inhibits manipulation with facility and the coarseness of the teeth can result in skin gouging.

In addition to this limitation on trimming which is introduced by the elongated array of relatively coarse teeth, former hair trimmers include cutters positioned in relatively close proximity to the housing of the appliance. Visibility of the cutter teeth by a party trimming his own hair is therefore relatively restricted. During the close trimming around ears, mustaches, etc., it is desirable that the cutter teeth are positioned so as to be substantially visible to the user.

Accordingly, it is an object of this invention to provide an improved hair trimmer of the type described having means for enhancing finish trimming of an individual's hair growth.

Another object of the invention is to provide a hair trimmer of the type described having a finish trimmer assembly which is demountably interchangeable with a clipper assembly for the device.

Another object of the invention is to provide a hair trimming appliance having enhanced visibility of the cutter teeth for the user to enable greater control in its manipulation.

SUMMARY OF THE INVENTION

In accordance with features of the invention, an improved hair trimming appliance comprises an elongated hand-held housing including a first housing or handle segment for housing an electrically energizable drive means and a second housing segment for housing a hair cutter means. The drive means is positioned in the handle segment and a drive member extends from the drive means to the second housing segment. The second housing segment alternatively includes a demountable clipper assembly or a demountable trimmer assembly. A clipper cutter assembly is supported by the demountable clipper assembly and a trimmer cutter assembly having a longitudinal array of cutter teeth is supported by the demountable trimmer assembly. The demountable trimmer assembly includes a segment for supporting and positioning the trimmer cutter assembly at a location which is displaced from the second housing segment with the array of cutter teeth extending in a direction parallel to the length of the appliance housing. With this arrangement, a trimmer assembly which is particularly adapted for trimming hair around the lower rear neck, earlobes, mustaches, etc., is provided; it is readily interchangeable with a clipper assembly; and it provides for enhanced visibility of the cutter teeth during use.

In accordance with more particular features of the invention the second housing segment includes a housing member extending the entire length of the appliance housing and a means including a hand-actuatable latch is provided for demountably captivating the clipper assembly, or alternatively, the trimmer assembly to the housing member.

In accordance with other more particular features of the invention, a drive extension is provided and is supported in the trimmer assembly for engaging both the trimmer cutter assembly and the drive member. The trimmer assembly includes a trimmer cover and a trimmer case which together form a housing for the trimmer cutter assembly.

BRIEF DESCRIPTION OF THE DRAWINGS

These and other objects and features of the invention will become apparent with reference to the following specification and the drawings wherein:

FIG. 7 is a view taken along lines 7—7 of FIG. 5;

FIG. 8 is a view taken along lines 8—8 of FIG. 5;

FIG. 9 is an enlarged, fragmentary, plan view of the hair trimmer of FIG. 1 which is partly broken away and which illustrates the trimmer assembly being mounted to the trimmer device; and, FIG. 10 is an enlarged, fragmentary, perspective, exploded view of the appliance of FIG. 1.

DETAILED DESCRIPTION

Figure 1:
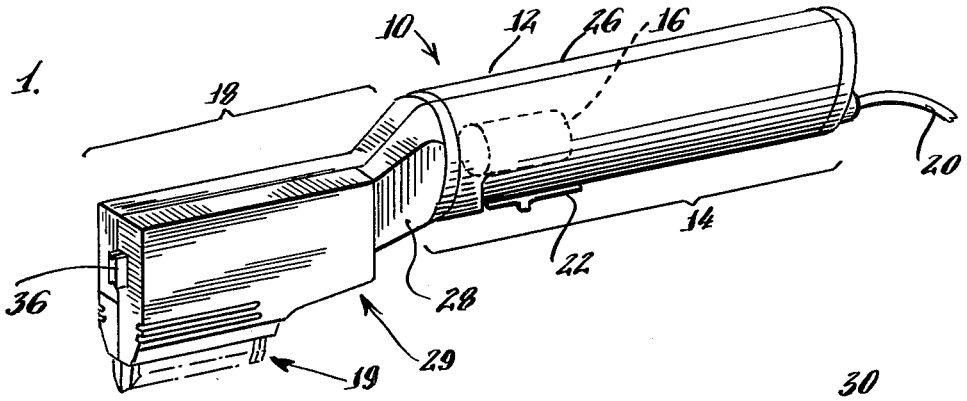
FIG. 1 is a perspective view of a hair trimmer constructed in accordance with features of one embodiment of the invention.
Figure 3:
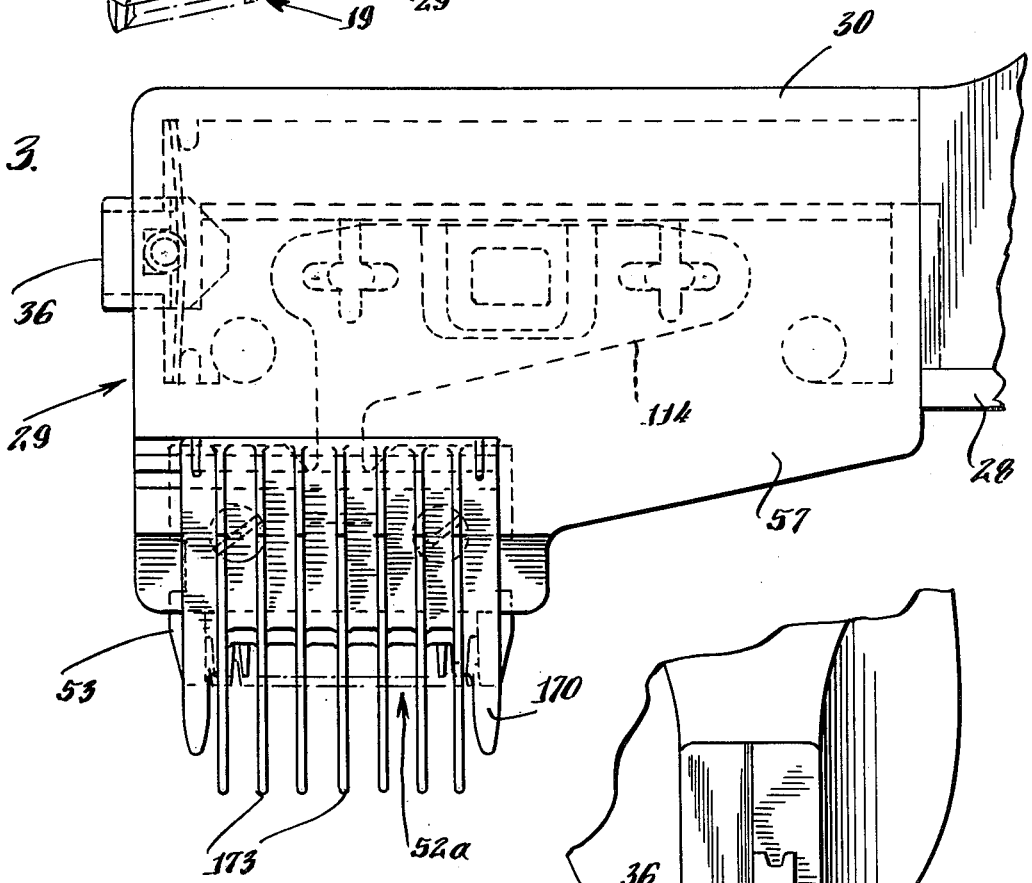
FIG. 3 is an enlarged, fragmentary, side elevation view of the hair trimmer of FIG. 1 having a comb mounted thereto.
Figure 4:
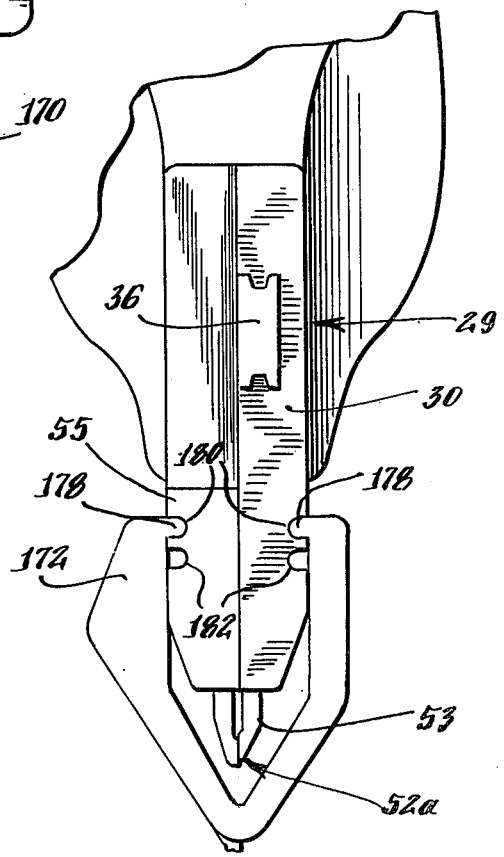
FIG. 4 is an enlarged, fragmentary, front elevation view of the hair trimmer of FIG. 1 having a comb member mounted thereto.

Referring now to FIG. 1, an electrically powered hair trimming appliance 10 is shown to comprise an elongated hand-held housing 12 which includes a first housing or handle segment 14 for housing an electrically energized drive means 16 and a second housing segment 18 for housing a cutter means 19. Drive means 16 comprises an electric motor, not shown, which is energized by electric power applied thereto via a line cord 20 or, alternatively, by batteries, not shown, and which are positioned within handle segment 14. First housing segment 14 provides a convenient hand grip for the user. A slide switch 22 is finger actuated for application or interruption of electrical energy to drive means 16. A drive member 24 (FIG. 2) is provided and extends from the drive means to the second housing segment for engaging and actuating cutter means 19, described hereinafter.

Figure 2:
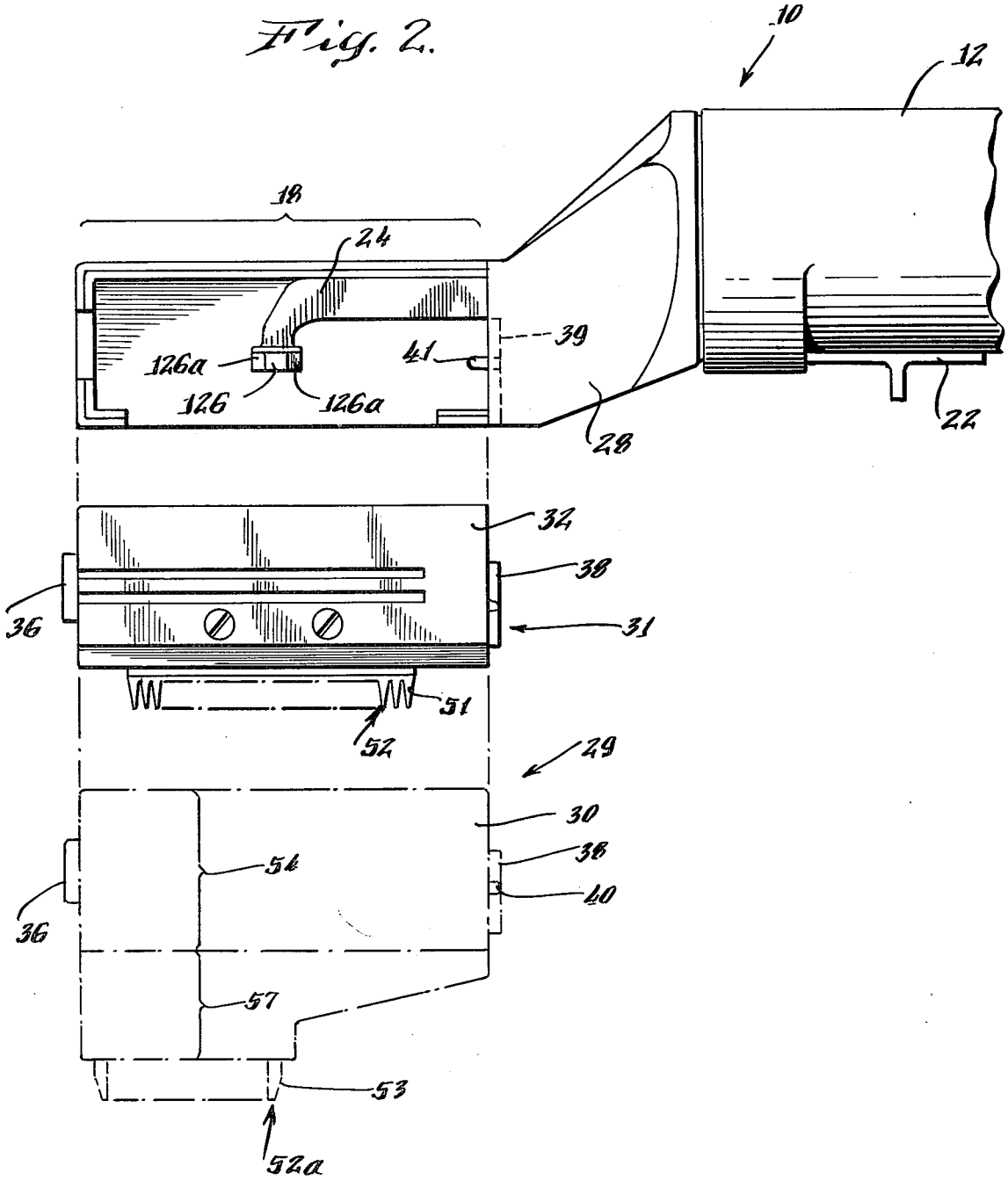
FIG. 2 is an enlarged, fragmentary, side elevation view of the hair trimmer of FIG. 1 illustrating a demounted clipper assembly and a demounted trimmer assembly.

In a preferred embodiment appliance housing 12 is formed of plastic and is split longitudinally and includes a housing member 26 extending the entire length of housing 12, a cover 28 forming one-half of first housing segment 14, and a demountable trimmer assembly 29 (FIG. 2). Alternatively, a demountable clipper assembly 31 (FIG. 2) is provided. Trimmer assembly 29 or, alternatively, clipper assembly 31 is captivated and secured to housing 12. In FIG. 2, those elements of trimmer assembly 29 and clipper assembly 31 which perform similar functions bear the same reference numerals.

Trimmer assembly 29 and clipper assembly 31 include a trimmer case 30 and a clipper case 32 respectively. Cases 30 and 32 are formed of plastic and shaped to provide, alternatively, with housing member 26 a housing for drive member 26. Trimmer case 30 or, alternatively, clipper case 32 together with housing member 26 comprise second housing segment 18.

As illustrated in FIGS. 2, 3, 4, 5 and 9, trimmer case 30 or, alternatively, clipper case 32 include a hand-actuatable latch member 36 positioned at a forward end of case 30 or 32 and an integrally formed tab 38 positioned at an opposite end of case 30 or 32. A recess 39 is formed in a portion of cover 28 and tab 38 is configured and positioned to engage recess 39. A slot 40 formed in tab 38 engages a rib 41 which is integrally formed in housing member 26 and establishes orientation of case 30 or 32 with respect to the appliance housing. Hand-actuatable latch member 36 is biased in a direction outwardly of assemblies 29 or 31 by a spring 43 (FIG. 5) which is captivated between bosses 44 and 45 which are integrally formed in trimmer case 30. As illustrated in FIG. 9, latch member 36 includes an extending hook 46 which engages a recess 47 at a distal end 48 of housing member 26. Trimmer case 30 is positioned on the housing by introducing tab 38 to recess 39 in the direction indicated by arrow 49 in FIG. 9. As trimmer case 30 is introduced, hook 46 is deflected sufficiently to engage recess 47 and maintain trimmer assembly 29 captivated on appliance housing 12.

Figure 10:
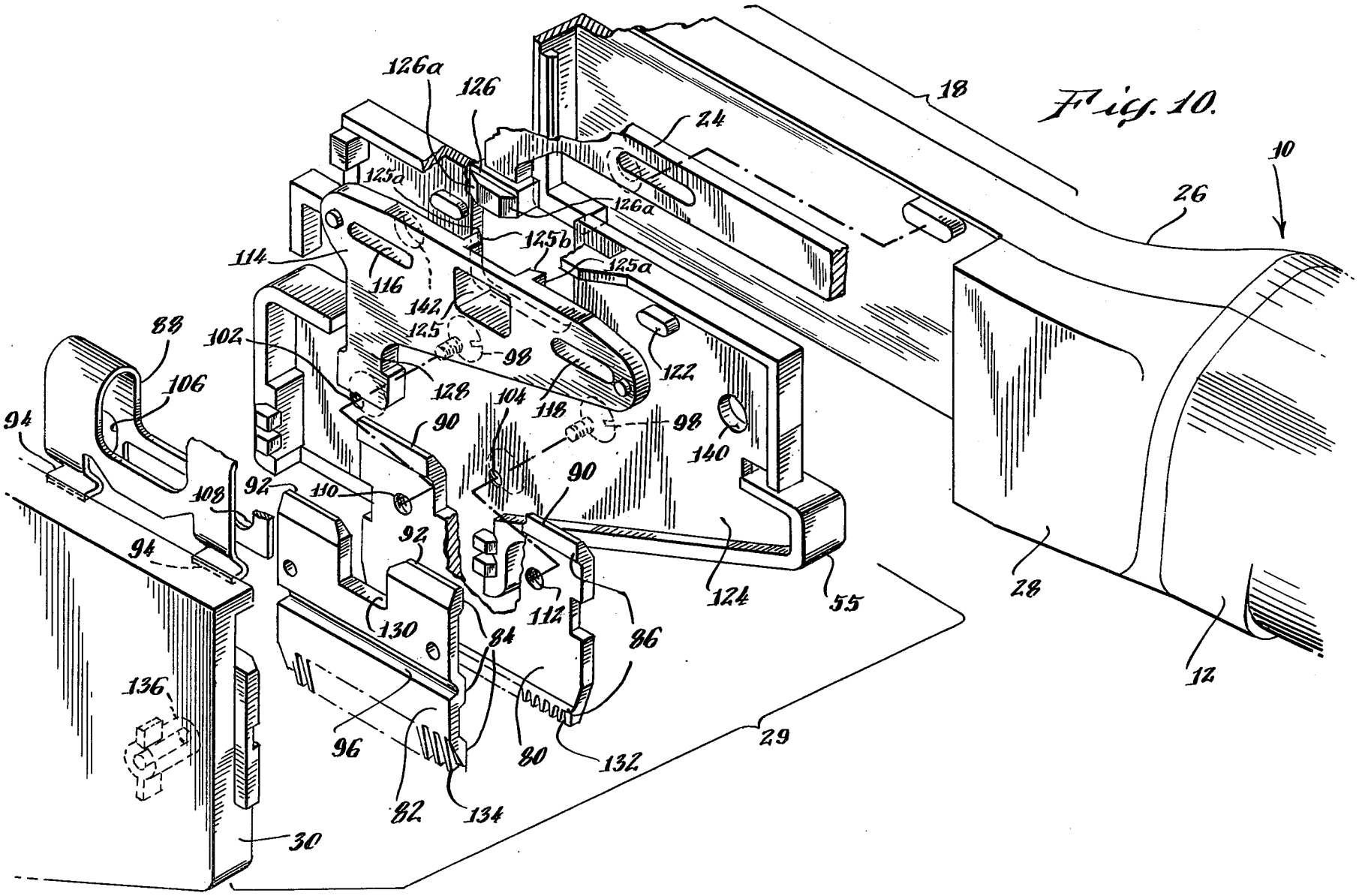

As illustrated in FIG. 2, clipper case 32 conforms in size and configuration with housing member 26 to provide a closure and housing for a clipper cutter assembly 51, described in greater detail in the aforementioned co-pending U.S. patent application. Clipper cutter assembly 51 and trimmer cutter assembly 53 include a plurality of teeth 52 and 52*a* respectively, which are aligned in a longitudinal array and when the cutter assemblies are positioned on housing 12 the array of teeth 52 or 52*a* extend in the direction of the length of the housing. Trimmer case 30 includes an upper segment 54 which forms with portions of housing member 26 and a trimmer cover 55 a housing for a drive extension 114, described hereinafter. Trimmer case 30 also includes a lower support segment 57 (FIG. 2) which supports trimmer cutter assembly 53 positioned at a location displaced from second housing segment 18 with the array of teeth 52*a* extending in a direction parallel to the length of trimmer assembly 29. Trimmer cover 55 (FIG. 10) cooperates with support segment 57 to house and shield trimmer cutter assembly 53 and a portion of the drive from the collection of cut hairs and the like. The positioning of trimmer cutter assembly 53 and a portion of the drive from the collection of cut hairs and the like. The positioning of trimmer cutter assembly 53 at a location displaced from housing 12 provides enhanced viewing of the array of cutter teeth 52*a* when trimming mustaches, hair around earlobes, and the like.

The array of cutter teeth 52*a* of trimmer cutter assembly 53 (FIGS. 5, 7, 8 and 10) include a stationary toothed cutter 80 and a movable toothed cutter 82. These cutters are juxtapositioned so that surfaces 84 of movable cutter 82 bears against surfaces 86 of stationary cutter 80 in sliding engagement. A generally saddle-shaped retaining spring 88 is positioned over shoulders 90 and 92 of cutters 80 and 82 respectively. Flanged segments 94 of retaining spring 88 are positioned in a groove 96 of movable cutter 82 for maintaining the cutters in alignment as movable cutter 82 is actuated with a reciprocating motion with respect to stationary cutter 80. Trimmer cutter assembly 53 is mounted to trimmer cover 55 by screws 98 and 100 which extend through apertures 102 and 104 respectively formed in trimmer cover 55 and through apertures 106 and 108 formed in retaining spring 88. These screws engage internally threaded apertures 110 and 112 respectively which are formed in stationary cutter 80.

Drive extension 114 is provided for coupling reciprocating motion from drive member 24 to movable cutter 82. Drive extension 114 includes grooves 116 and 118 into which extend guide bosses 120 and 122 respectively. Guide bosses 120 and 122 are integrally formed on a wall 124 of trimmer cover 55 and limit motion of drive extension 114 to rectilinear motion.

Drive extension 114 further includes a seat member 125 for receiving a depending segment 126 of drive member 24. Seat member 125 is formed by wall members 125*a* which project from and are arranged perpendicular to a surface of drive extension 114. Wall members 125*a* form an opening having sloping surface portions 125*b* formed at an acute angle with respect to the wall members 125*a*. Depending segment 126 is provided with sloping surface portions 126*a* formed for complementary engagement with surface portions 125*b* on seat member 125. After an initial operation of drive means 16 drive member 24 will assume, within the limits of the length of reciprocating stroke imparted thereto by the drive means, a random at-rest position. Similarly drive extension 114 will assume, within the limits imposed by the length grooves 116 and 118 and the spacing between guide bosses 120 and 122, a random at-rest position. The positioning and slope of surfaces 125*b* and 126*a* are selected to provide an overlap therebetween regardless of the at-rest position of drive member 24 or drive extension 114. The sloping surface portions 125*b* and 126*a* provide means for automatic coupling of drive extension 114 with drive member 24 when trimmer assembly 29 is mounted to the appliance housing. As trimmer assembly 30 is mounted to the housing as shown in FIG. 9 the overlapping portions of surfaces 125*b* and 126*a* will come into contact and due to the complementary slopes of these surfaces a camming action occurs between these surfaces and drive extension 114 along with movable cutter 82 will be moved until the opening in seat member 125 is aligned with depending segment 126 thereby allowing the depending segment to enterinto the opening for seated engagement with the seat member.

As drive member 24 reciprocates, drive extension 114 is simultaneously reciprocated. Drive extension 114 includes a depending segment 128 which engages a slot 130 of movable cutter 82. Reciprocating motion of drive extension 114 thereby causes corresponding reciprocating motion of movable cutter 82.

Cutters 80 and 82 include cutter teeth 132 and 134 respectively. The spacing or pitch between teeth 132 and 134 is substantially less than the spacing or pitch provided on clipper cutter teeth 52. Thus, the potential for gouging of skin adjacent the hair being cut is substantially reduced. In addition, the length of the elongated array of cutter teeth **52*a* is selected to provide ready manipulation of trimmer assembly 29 over the body portions on which hair is to be cut. More particularly, the array of cutter teeth 52*a* has a length on the order of about 1 inch, for example, which enables the trimmer cutter assembly to be readily manipulated around the lower rear neck, over mustaches, over hair around earlobes, etc. In contrast, the array of clipper cutter teeth 52 used for cutting hair bulk has a length of about 1½ to 2 inches and has a tooth pitch which is substantially greater than that provided by trimmer cutter teeth 132 and 134**.

Figure 5:
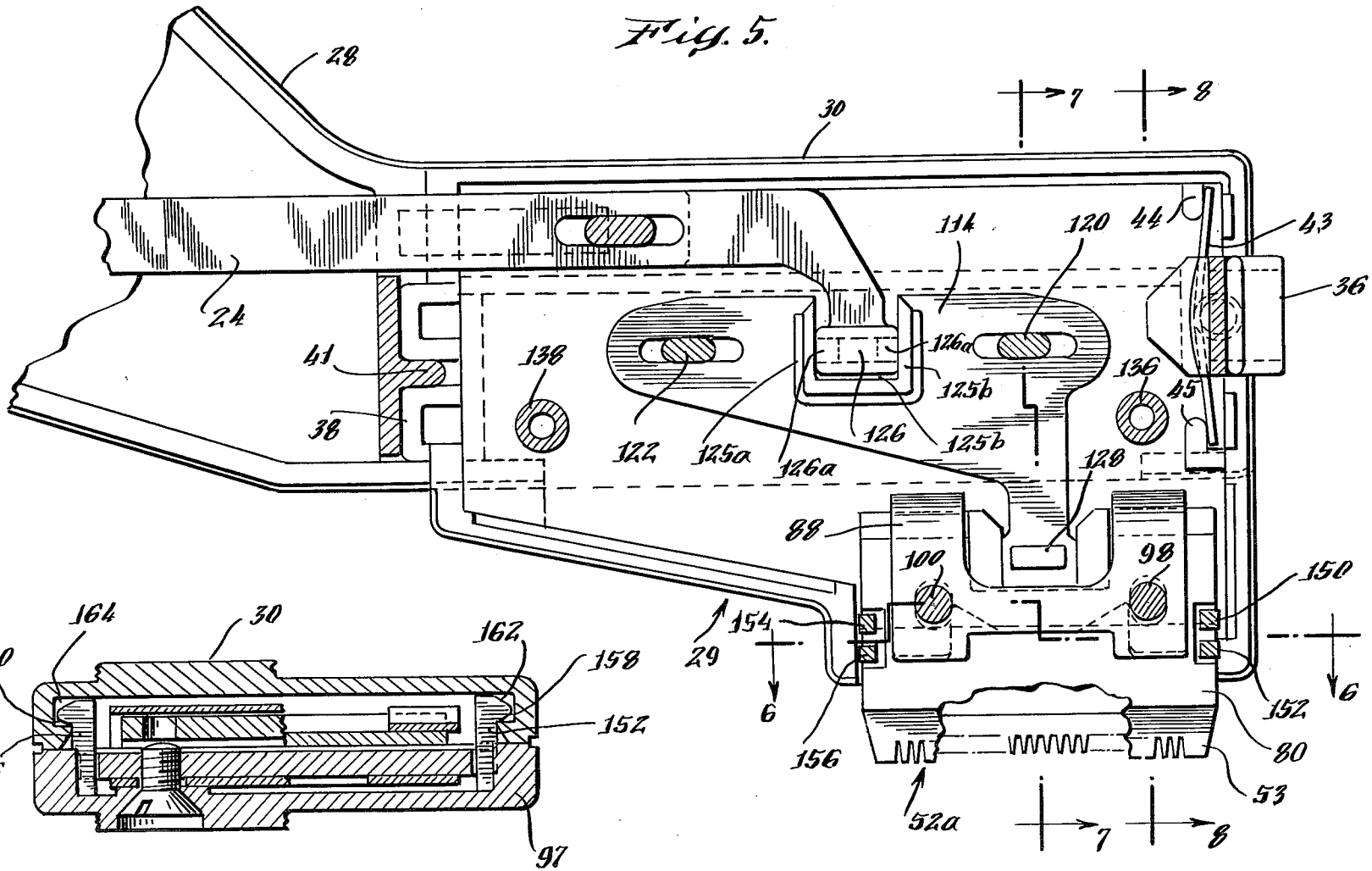
FIG. 5 is an enlarged, fragmentary, side elevation view, partly cut away, of a section of the trimmer of FIG. 1.
Figure 6:
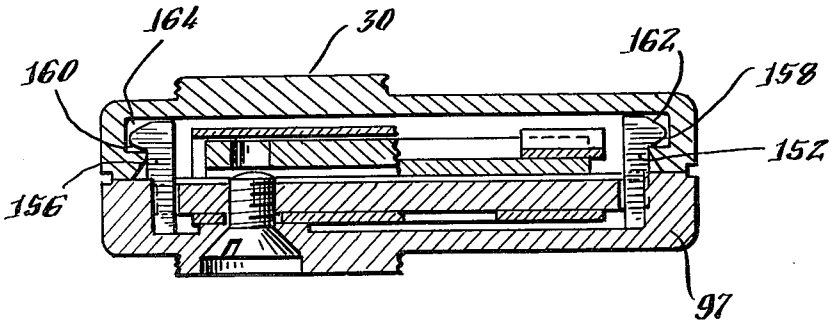
FIG. 6 is a view taken along lines 6—6 of FIG. 5.

Trimmer cutters 80 and 82 are assembled and mounted to trimmer cover 55 as indicated hereinbefore. In order to facilitate cleaning of trimmer cutter assembly 53, trimmer cover 55 is demountably supported on lower support segment 57. Demountable support is provided by a pair of heat deformable bosses 136 and 138 having recesses 144 and 146 formed centrally thereof (FIG. 5). Bosses 136 and 138 extend through apertures 140 and 142 respectively in trimmer cover 55. Bosses 136 and 138 are heat deformed to provide engagement over apertures 140 and 142. Trimmer cover 55 can be separated from support segment 57 by removing the heat deformed ends of bosses 136 and 138, by chipping or the like. Remounting is provided by self-threading screw means, not illustrated, which extend through apertures 140 and 142, and into threaded engagement with recesses 144 and 146 in bosses 136 and 138. In addition, trimmer cover 55 includes integrally formed, deflectable latch means provided by latch arms 150, 152, 154 and 156 as illustrated in FIGS. 5 and 6. The latch arms engage ridges 158 and 160 which are integrally formed in trimmer case 30. The latch arms can be deflected by insertion of a small tool in spaces 162 and 164 as illustrated in FIG. 6 to release the latch arms and to permit demounting of trimmer cover 55 from support segment 57. Latch elements 150, 152, 154 and 156 maintain the orientation of cutters 80 and 82 with respect to trimmer case 30.

At times it is desirable to utilize a comb for directing the hair to be cut toward the cutter teeth. To this end, a comb member 170 is provided having an elongated, generally U-shaped support segment 172 (FIG. 4) and a plurality of comb teeth 173 depending therefrom. Comb member 170 may be positioned at different locations with respect to the array of trimmer cutter teeth **52*a* by positioning laterally extending comb tabs 178 in selected grooves 180, 182** which are formed in trimmer case. A comb construction of this type is described in further detail and is claimed in the aforementioned copending U.S. patent application.

There has thus been described an improved hair trimming device which is adapted to interchangeably utilize a clipper cutter and a trimmer cutter. Hand-actuatable means are provided for demounting the cutters. A trimmer case is provided having an extended lower support segment for positioning a cutter means at a location which enhances the viewability of the trimmer cutter teeth when utilized for trimming mustaches, hair around earlobes, and the like.

While there has been described a particular embodiment of the invention, it will be appreciated that variations may be made thereto by those skilled in the art without departing from the spirit of the invention and the scope of the appended claims.

What is claimed is:

1. A hand-held, electrically energized hair trimmer comprising:

a. an elongated hand-held trimmer housing having a length thereof and including a first housing segment housing an electrical energizable drive means and a second housing segment for supporting a cutter assembly;

b. a drive member operatively engaged with said drive means extending from said drive means to said second housing segment and mounted for linear reciprocating motion within said second housing segment;

c. said second housing segment alternatively including a demountable clipper assembly or a demountable trimmer assembly, said trimmer assembly including a drive extension member mounted for linear reciprocating movement therein;

d. a clipper cutter assembly supported by said demountable clipper assembly and a trimmer cutter assembly having a longitudinally extending array of cutter teeth supported by said demountable trimmer assembly in operative engagement with said drive extension member;

e. said demountable trimmer assembly including a segment thereof for supporting said trimmer cutter assembly at a location laterally spaced from said drive member and said second housing segment said array of cutter teeth extending in a direction parallel to the length of said trimmer housing;

f. said clipper cutter assembly positioned on said second housing segment in operative engagement with said drive member or said trimmer cutter assembly alternatively positioned on said second housing segment, said drive extension member spanning the lateral space between said drive member and said trimmer cutter assembly in operative engagement between said drive member and said trimmer cutter assembly.

2. The hair trimmer of claim 1 including a cover and a case for said trimmer assembly, said trimmer cutter assembly is mounted to said cover, and said cover is mounted to said trimmer case.

3. The hair trimmer of claim 2 wherein said cover forms with said trimmer case a housing for the trimmer cutter assembly.

4. The hair trimmer of claim 3 wherein means are provided for demounting said cover from said trimmer case.

5. A demountable trimmer unit for relatively fine trimming of hair, said trimmer unit being readily interchangeable with a demountable clipper unit of a hand-held clipper unit for relatively coarse clipping of hair, said trimmer unit enhancing visibility of cutter teeth of the trimmer unit during fine hair trimming operations around earlobes, mustaches, and the like, said clipper unit including a cutter assembly having a stationary blade and a movable blade having a drive notch formed therein, said hair clipper including an elongated housing having a first segment housing an electrically energizable drive means therein, and a second segment extending from said first segment, said second segment housing a drive member in operative engagement with said drive means, said drive member being operable for linear reciprocating motion within said second segment, means for demountably positioning said clipper unit on said second segment with said drive member in operative engagement with said drive notch of the movable clipper cutter, said trimmer unit comprising a trimmer cutter assembly having a stationary trimmer blade and a movable trimmer blade having a drive slot formed therein, said movable trimmer blade mounted for linear reciprocating movement in said trimmer unit, means for demountably positioning said trimmer unit on said second segment in place of said clipper unit, said trimmer cutter assembly and said drive slot of the movable trimmer blade being located at a position laterally spaced from said second segment of the housing and from said drive member, and a drive extension member mounted on said trimmer unit for linear reciprocating movement therein, said drive extension member spanning the lateral space between said drive member and said drive slot upon said positioning of said trimmer unit on said second segment for coupling linear reciprocatory motion of said drive member to said movable trimmer blade.

6. The trimmer unit of claim 5 wherein a depending segment is formed on said drive extension member, said depending segment being in operative mating engagement with said drive slot of the movable trimmer blade and wherein a seat member is formed on said drive extension member spaced from said depending segment, said seat member being formed for complementary mating engagement with said drive member upon said positioning of the trimmer unit on said second segment of the hair clipper housing whereby linear reciprocating motion of the drive member causes corresponding linear reciprocating motion of the drive extension member and said movable trimmer blade.

7. The trimmer unit of claim 6 wherein said seat member includes wall members projecting from and being arranged perpendicular to a surface of said drive extension member, said wall members being formed with surfaces arranged at an acute angle with respect to said wall members, said angled surfaces forming an opening therebetween for receiving said drive member upon said positioning of the trimmer unit on the second segment of the hair clipper housing.

8. The trimmer unit of claim 7 wherein said drive extension member is formed with longitudinally spaced grooves therein and said trimmer unit includes a trimmer case member and a trimmer cover member enclosing said drive extension member and said trimmer cutter assembly, said trimmer cover member being formed with guide bosses extending into said spaced grooves for limiting movement of the drive extension member to linear reciprocating motion.

9. The trimmer unit of claim 8 wherein said drive extension member assumes a random at-rest position within limits imposed by the length of said spaced grooves engaged with said bosses on the trimmer cover, the acute angle of the angled surfaces of said wall members and the position of said seat member on said drive extension member being selected to provide for said mating engagement of the drive member with said seat member regardless of said random at-rest position of the drive extension member.

10. The trimmer unit of claim 8 wherein said trimmer case member includes an upper segment and a lower segment, said lower segment supporting said trimmer cutter assembly at a position displaced from said second segment of the hair clipper housing and said upper segment forming with said second segment a housing for said drive extension member.

* * * * *